US010077917B2

(12) United States Patent
Amick et al.

(10) Patent No.: US 10,077,917 B2
(45) Date of Patent: Sep. 18, 2018

(54) DRAIN PAN ASSEMBLY FOR FAN COIL UNIT

(71) Applicant: Carrier Corporation, Farmington, CT (US)

(72) Inventors: James Amick, Coatesville, IN (US); Alice R. Walker, Plainfield, IN (US); Kevin Mercer, Danville, IN (US); Frank J. David, Danville, IN (US); Merle D. Sears, Mooresville, IN (US); Shafi N. Khan, Liverpool, NY (US); Barry W. Lee, Greenwood, IN (US); Christine Cantwell, Indianapolis, IN (US)

(73) Assignee: CARRIER CORPORATION, Farmington, CT (US)

( * ) Notice: Subject to any disclaimer, the term of this patent is extended or adjusted under 35 U.S.C. 154(b) by 525 days.

(21) Appl. No.: 14/272,152

(22) Filed: May 7, 2014

(65) Prior Publication Data

US 2014/0332189 A1 Nov. 13, 2014

Related U.S. Application Data

(60) Provisional application No. 61/821,399, filed on May 9, 2013.

(51) Int. Cl.
*H01L 23/467* (2006.01)
*F24F 13/20* (2006.01)
(Continued)

(52) U.S. Cl.
CPC ..... *F24F 13/20* (2013.01); *F24F 1/0007* (2013.01); *F24F 13/22* (2013.01);
(Continued)

(58) Field of Classification Search
CPC ..... F25D 21/14; F25D 2321/144; F24F 13/22
(Continued)

(56) References Cited

U.S. PATENT DOCUMENTS 4,129,013 A * 12/1978 Hine, Jr. ..... F24F 1/02 165/136
4,907,420 A * 3/1990 Mahanay ..... F25D 21/14 62/285

(Continued)

FOREIGN PATENT DOCUMENTS

EP 2455221 A1 5/2012
GB 2471283 A 12/2010

OTHER PUBLICATIONS

Publication from Johnson Controls entitled "FS Fan-Coil Units Hi-Rise, Vertical", published in 2008.*

*Primary Examiner* — Len Tran
*Assistant Examiner* — Paul Alvare
(74) *Attorney, Agent, or Firm* — Cantor Colburn LLP

(57) ABSTRACT

A fan coil unit is provided including a cabinet formed from a plurality of panels. A fan assembly is configured to circulate air through the cabinet. A heat exchanger assembly is positioned within the cabinet. The heat exchanger assembly includes at least one heat exchanger coil arranged in a heat transfer relationship with the air circulating through the cabinet. An inner surface of at least one of the plurality of panels is partially lined with an elastomeric foam insulation so that the air circulating through the cabinet does not contact the portion of the at least one panel lined with the elastomeric foam insulation.

6 Claims, 7 Drawing Sheets

(51) Int. Cl.
*F24F 1/00* (2011.01)
*F24F 13/22* (2006.01)
*F25D 21/14* (2006.01)

(52) U.S. Cl.
CPC ..... *F24F 2013/221* (2013.01); *F25D 21/14* (2013.01); *F25D 2321/144* (2013.01)

(58) Field of Classification Search
USPC ..... 62/150, 285, 288, 291; 165/71; 220/571, 220/571.1
See application file for complete search history.

(56) References Cited

U.S. PATENT DOCUMENTS 5,460,290 A 10/1995 Hanning
5,511,386 A * 4/1996 Russ ..... F24F 13/22 62/285
5,713,651 A 2/1998 Essig
5,860,290 A 1/1999 Gregory et al.
5,924,392 A 7/1999 Hall
6,029,846 A 2/2000 Hirath
6,217,140 B1 4/2001 Hirath
6,220,685 B1 4/2001 Hirath
6,360,545 B1 3/2002 Goldstone
6,588,378 B1 7/2003 Henderson
6,779,357 B1 8/2004 Fann
6,823,899 B2 11/2004 Weibel
6,868,689 B1 * 3/2005 McNeil ..... F24F 13/222 62/285
6,964,282 B2 11/2005 Babineau, Jr.
6,983,565 B2 1/2006 Berry
7,257,952 B2 8/2007 Bishop
7,334,377 B2 2/2008 Dubensky
7,430,835 B1 10/2008 Larson
7,451,614 B2 11/2008 Luehrs
7,526,903 B2 5/2009 Kandasamy
7,596,956 B2 10/2009 Lilke
7,641,298 B2 1/2010 Hirath
7,645,003 B2 1/2010 Wenning
7,678,434 B2 3/2010 Phillips
7,757,510 B2 7/2010 Rosete
7,854,240 B2 12/2010 Meller
7,937,895 B2 5/2011 Janka
8,061,097 B2 11/2011 Holt
8,091,313 B2 1/2012 Wilson
8,163,811 B2 4/2012 Quante
8,186,388 B2 5/2012 Princell
8,282,452 B2 10/2012 Grigsby
8,291,660 B2 10/2012 McCary
8,297,468 B1 10/2012 Delay
8,313,818 B2 11/2012 Vo
8,371,338 B2 2/2013 Princell
2005/0244597 A1 * 11/2005 Phillips ..... F24F 13/20 428/34.1
2007/0169493 A1 * 7/2007 Rios ..... F25D 21/14 62/285
2007/0169497 A1 * 7/2007 Rios ..... F24F 13/222 62/285
2008/0142525 A1 * 6/2008 Brouillette ..... F24F 13/222 220/571
2009/0064699 A1 * 3/2009 Miller ..... F24F 13/222 62/291
2010/0059501 A1 * 3/2010 Davidson ..... H05B 3/68 219/465.1
2011/0031254 A1 2/2011 Mortarotti
2011/0232860 A1 9/2011 Lackie
2011/0232861 A1 9/2011 Stewart
2012/0000231 A1 1/2012 Lafontaine
2012/0040161 A1 2/2012 Weidinger
2012/0297794 A1 11/2012 Tuszkiewicz

* cited by examiner

DRAIN PAN ASSEMBLY FOR FAN COIL UNIT

CROSS-REFERENCE TO RELATED APPLICATION

This application claims the benefit of U.S. provisional patent application Ser. No. 61/821,399 filed May 9, 2013, the entire contents of which are incorporated herein by reference.

BACKGROUND OF THE INVENTION

The invention relates generally to a fan coil unit of a heating, ventilation, and air conditioning system, and, more particularly, to insulation configured for use around the interior of a fan coil unit.

In humid environments, condensation may collect on the outside of a housing of a fan coil unit installed in an unconditioned space, such as a garage, basement, or attic for example. This condensation forms as a result of the conditioned air within the housing contacting the metal surfaces of the housing resulting in a thermal bridge. Some housings include bent metal flanges that extend directly into the conditioned air stream. In other housings, the conditioned air stream leaks around the insulation lining the interior surfaces of the housing. Over time, the condensation that collects on and ultimately drips from the outside of the housing of the fan coil unit may result in water damage to a customer's property.

Conventional fan coil units limit the amount of leakage using gaskets and other sealing technologies. Some geographic regions are adjusting the allowable leakage standard for low leakage certified units. For example, California has proposed a new regulatory leakage standard of 1.4% at 0.5IN. WC. Some existing systems may not be able to meet these newer standards without significant modification and added expense.

BRIEF DESCRIPTION OF THE INVENTION

According to an aspect of the invention, a fan coil unit is provided including a cabinet formed from a plurality of panels. A fan assembly is configured to circulate air through the cabinet. A heat exchanger assembly is positioned within the cabinet. The heat exchanger assembly includes at least one heat exchanger coil arranged in a heat transfer relationship with the air circulating through the cabinet. A portion of an inner surface of at least one of the plurality of panels is lined with an elastomeric foam insulation. The air circulating through the cabinet does not contact the inner surface of the portion of the at least one panel lined with the elastomeric foam insulation.

According to another aspect of the invention, a drain pain is provided including a substantially rigid body having a horizontal section adjacent a first end and an angled section adjacent a second, opposite end. The second end is spaced apart from a plane of the first end by a vertical distance. A first connector configured to receive and support a plastic drain pan extends from the first end of the rigid body. An elastomeric foam insulation lines a surface of the rigid body.

These and other advantages and features will become more apparent from the following description taken in conjunction with the drawings.

BRIEF DESCRIPTION OF THE DRAWINGS

The subject matter, which is regarded as the invention, is particularly pointed out and distinctly claimed in the claims at the conclusion of the specification. The foregoing and other features, and advantages of the invention are apparent from the following detailed description taken in conjunction with the accompanying drawings in which:

DETAILED DESCRIPTION OF THE INVENTION

Figure 1:
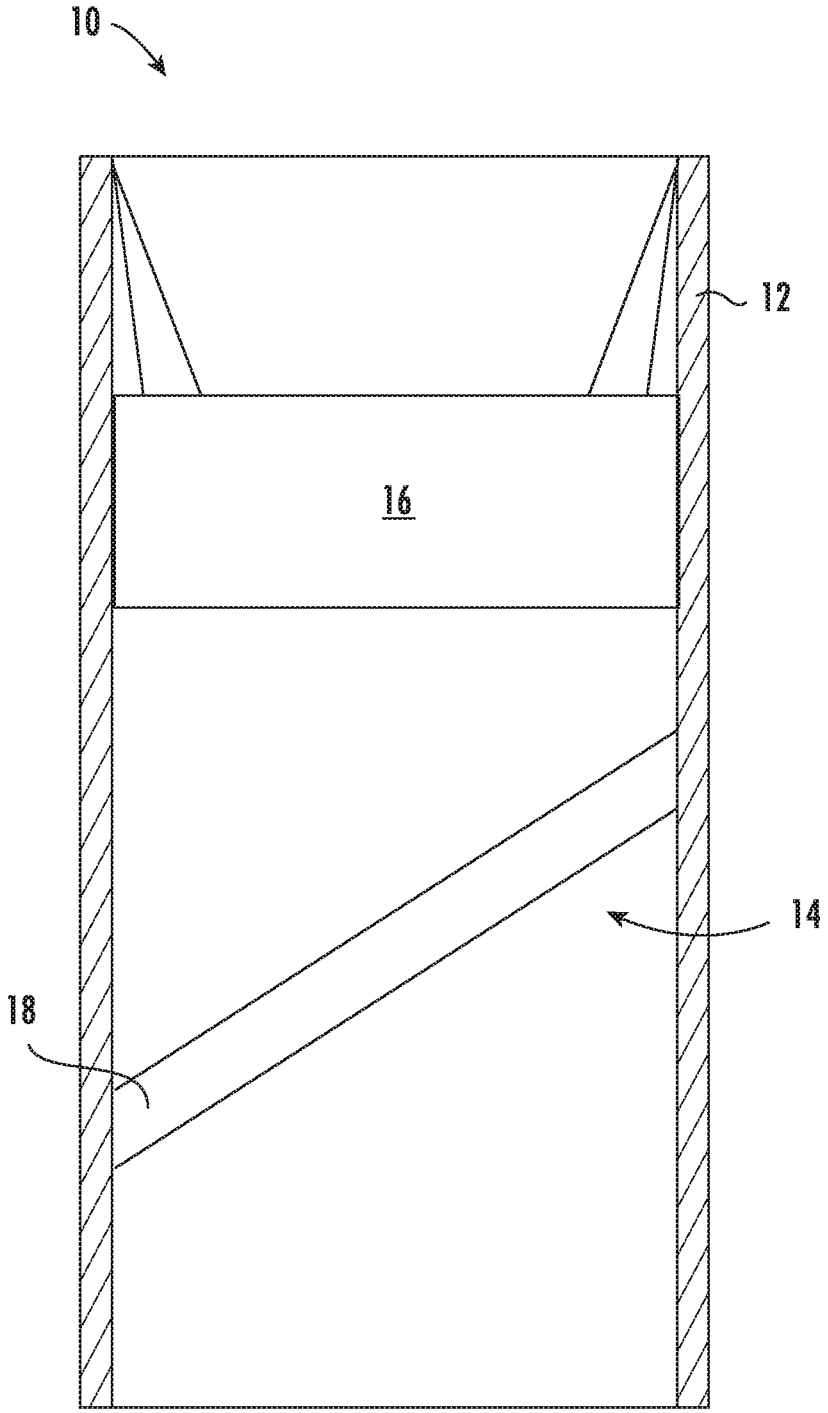
FIG. 1 is a cross-sectional view of an exemplary fan coil unit of a heating, ventilation, and air conditioning system.

Referring now to the FIGS., a fan coil unit 10 of a heating, ventilation, and air conditioning (HVAC) system is illustrated. The fan coil unit 10 includes a cabinet or housing duct 12 within which various components are located. For example, housed within the cabinet 12 of the fan coil unit 10 is a heat exchanger assembly 14 configured to heat or cool the adjacent air and a fan assembly 16 configured to circulate air through the heat exchanger assembly 14. Depending on the desired unit characteristics, the fan assembly 16 may be positioned either downstream with respect to the heat exchanger assembly 14 (i.e. a "draw through" configuration), as shown in FIG. 1, or upstream with respect to the heat exchanger assembly 14 (i.e. a "blow through" configuration).

The heat exchanger assembly 14 may include any of a plurality of configurations. As illustrated in FIG. 1, the heat exchanger assembly 14 is a single heat exchanger coil 18 arranged at an angle with respect to the flow path of air through the cabinet 12. Alternative configurations of the heat exchanger assembly 14 may include multiple heat exchanger coils 18 arranged in a generally V-shaped configuration, a generally A-shaped configuration, or a generally N-shaped configuration, as is known in the art. In embodiments where the fan coil unit 10 is configured to provide cool air, the heat exchanger assembly 14 absorbs heat from the air passing through the heat exchanger assembly 14 and the resultant cool air is provided to a space to be conditioned.

Figure 2:
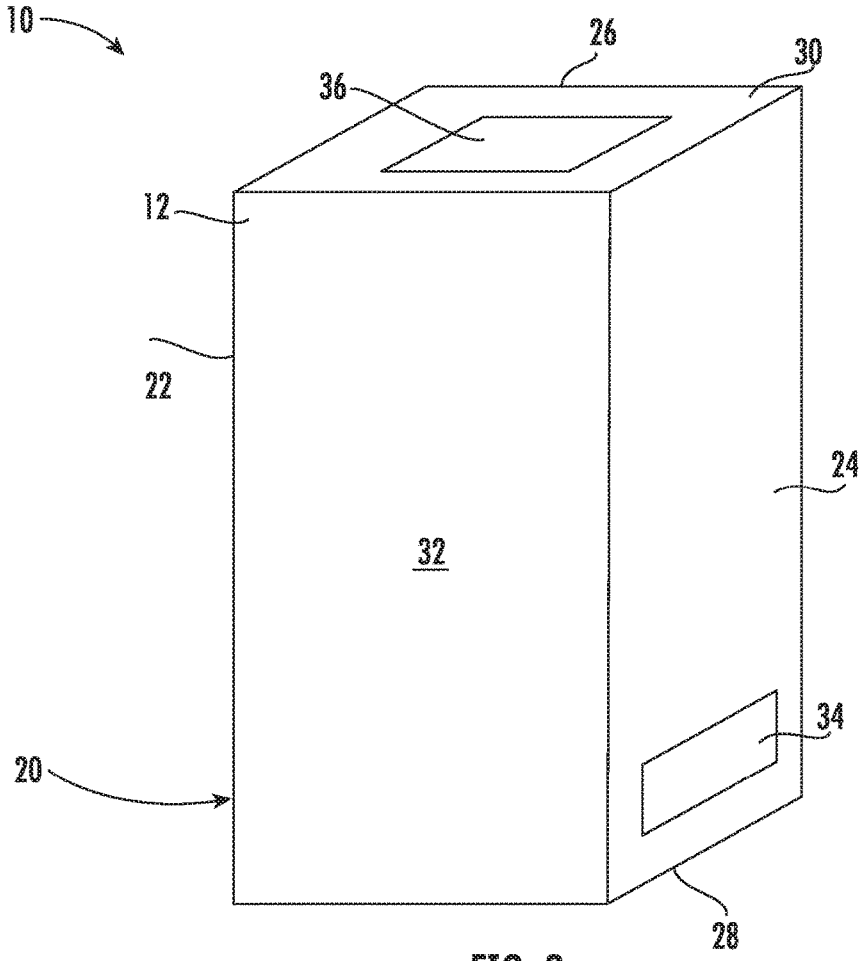
FIG. 2 is a perspective view of a cabinet of a fan coil unit according to an embodiment of the invention.
Figure 3:
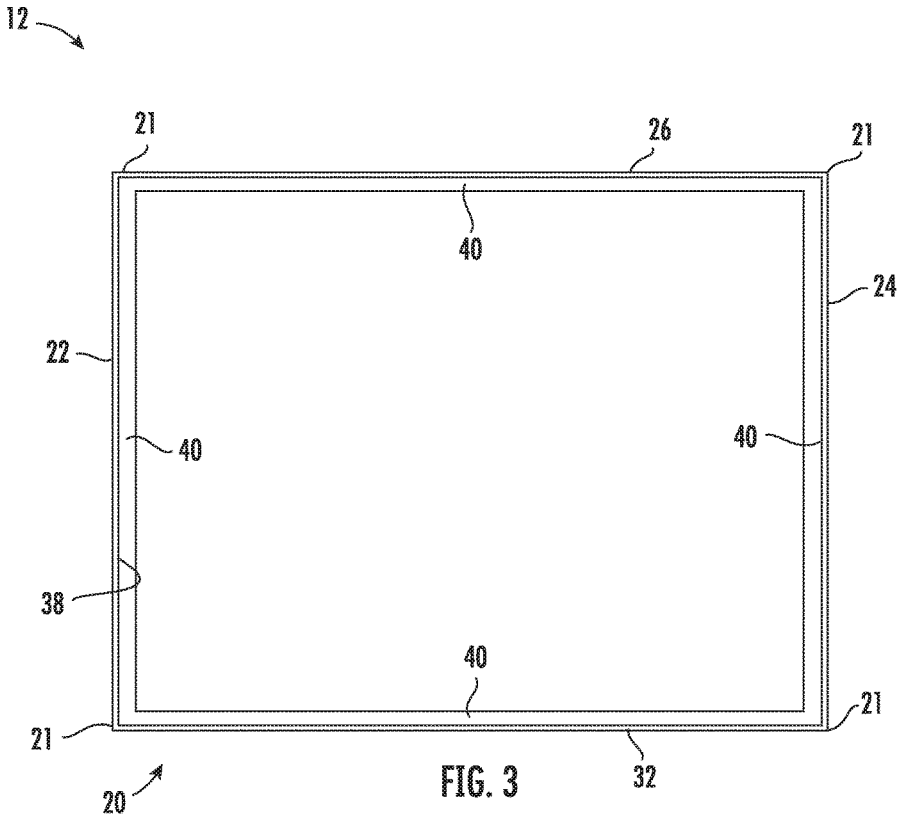
FIG. 3 is a top, cross-sectional view of a cabinet of a fan coil unit according to an embodiment of the invention.
Figure 4:
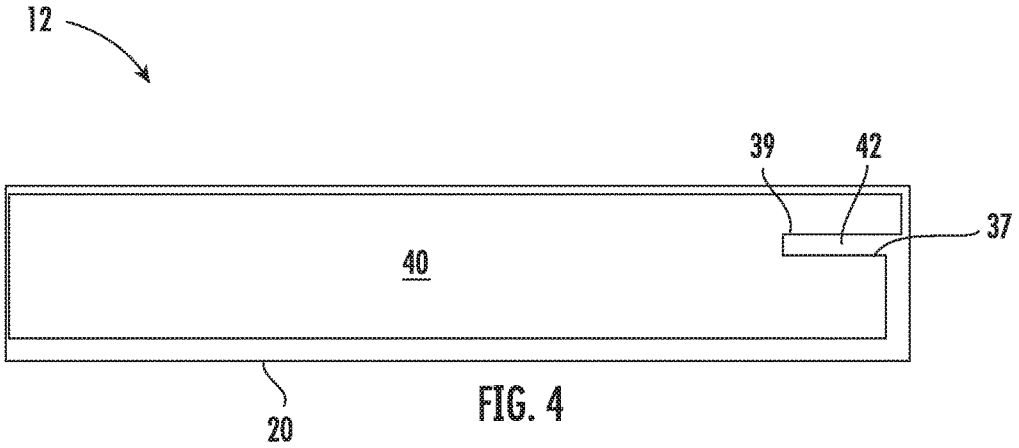
FIG. 4 is a cross-sectional view of a portion of a fan coil unit according to another embodiment of the invention.

Referring now to FIGS. 2-4, the cabinet 12 of the fan coil unit 10 is provided in more detail. The cabinet 12 is formed from a plurality of panels 20 including an opposing left side panel 22, right side panel 24, and rear panel 26. The cabinet 12 also includes end panels 28, 30 which enclose both the upper and lower ends of the cabinet 12, respectively. A front panel 32 is arranged opposite the rear panel 26 and generally encloses the fan coil unit 10. In one embodiment, the front panel 32 is mounted to one of the left side panel 22 and the right side panel 24. The front panel 32 is configured to move between a closed position and an open position to provide access to the plurality of components stored within the cabinet 12. The cabinet 12 includes at least one inlet opening 34 through which air to be conditioned travels to the interior of the cabinet 12. The air being heated or cooled in the fan coil unit 10 may be provided from a return air duct (not shown) connected to a space to be conditioned, or alternatively, may be fresh air drawn in from an outside source or a mixture of return air and fresh air. The cabinet 12 similarly includes at least one outlet opening 36, such as formed in end panel 30 for example. The outlet opening 36 may, but need not be, connected to ductwork (not shown) to guide and deliver the supply air from the fan cod unit 10 to one or more locations spaces to be conditioned.

As illustrated in FIG. 3, pieces of elastomeric foam insulation 40 having a substantially closed cell structure are arranged about the interior surface 38 of the cabinet 12 to prevent the cool supply air generated within the fan coil unit 10 from contacting the metal panels of the cabinet 12. In one embodiment, the elastomeric foam insulation 40 is bonded to the interior surface 38 of each panel 20, such as with glue or another adhesive for example. Each piece of elastomeric foam insulation 40 may have a size substantially similar to the size of the panel 20 to which the insulation sheet is configured to attach. Alternatively, a plurality of smaller pieces of insulation 40 may attach to each panel 20 of the cabinet 12. Exemplary elastomeric foam insulations 40 that may be used include, but are not limited to, Armacell AP/Armaflex®, K-FLEX USA K-FLEX Clad®, and K-FLEX USA K-FLEX Duct® for example. In one embodiment, adjacent pieces of insulation 40 positioned generally perpendicularly to one another, such as near the corners 21 of the cabinet 12 for example, are arranged to have an interference fit. As a result of the resilient nature and compressive strength of the elastomeric foam insulation 40, the interference fit forms a tight seal, thereby preventing cool air from leaking between the adjacent pieces of elastomeric foam insulation 40 and contacting the metal panels 20 of the cabinet 12. FIG. 4 also illustrates that the elastomeric foam insulation 40 may be configured to substantially surround a bent metal flange 37 extending inwardly from a panel 20 of the cabinet. In one embodiment, illustrated in FIG. 4, a slit 42, substantially parallel to the panel 20, is formed in the piece of elastomeric foam insulation 40. The end 39 of the flange 37 is received within the slit 42 to prevent the cool air within the fan coil unit 10 from contacting the flange 37.

Figure 5:
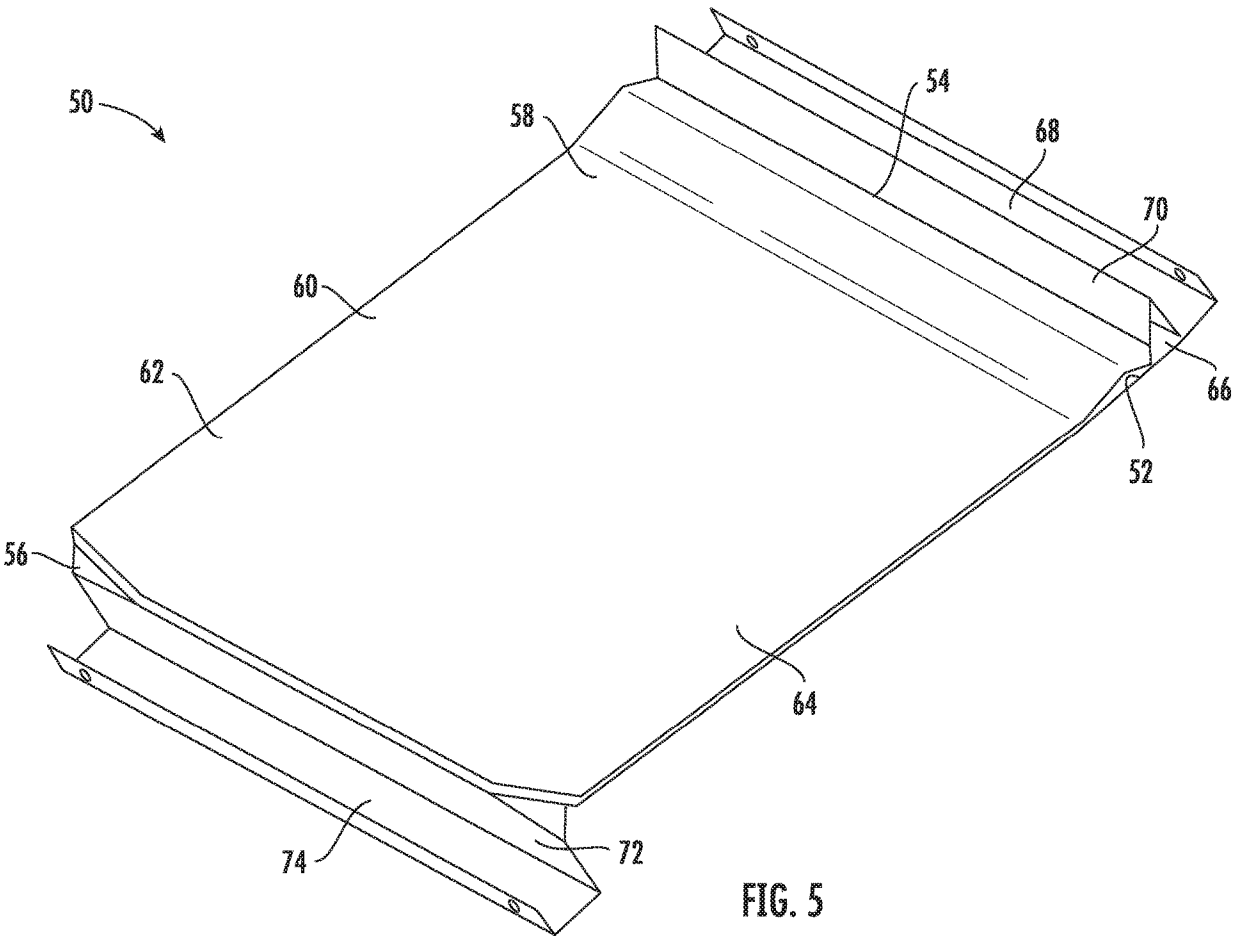
FIG. 5 is a perspective view of a drain pan of a fan coil unit according to an embodiment of the invention.
Figure 6:
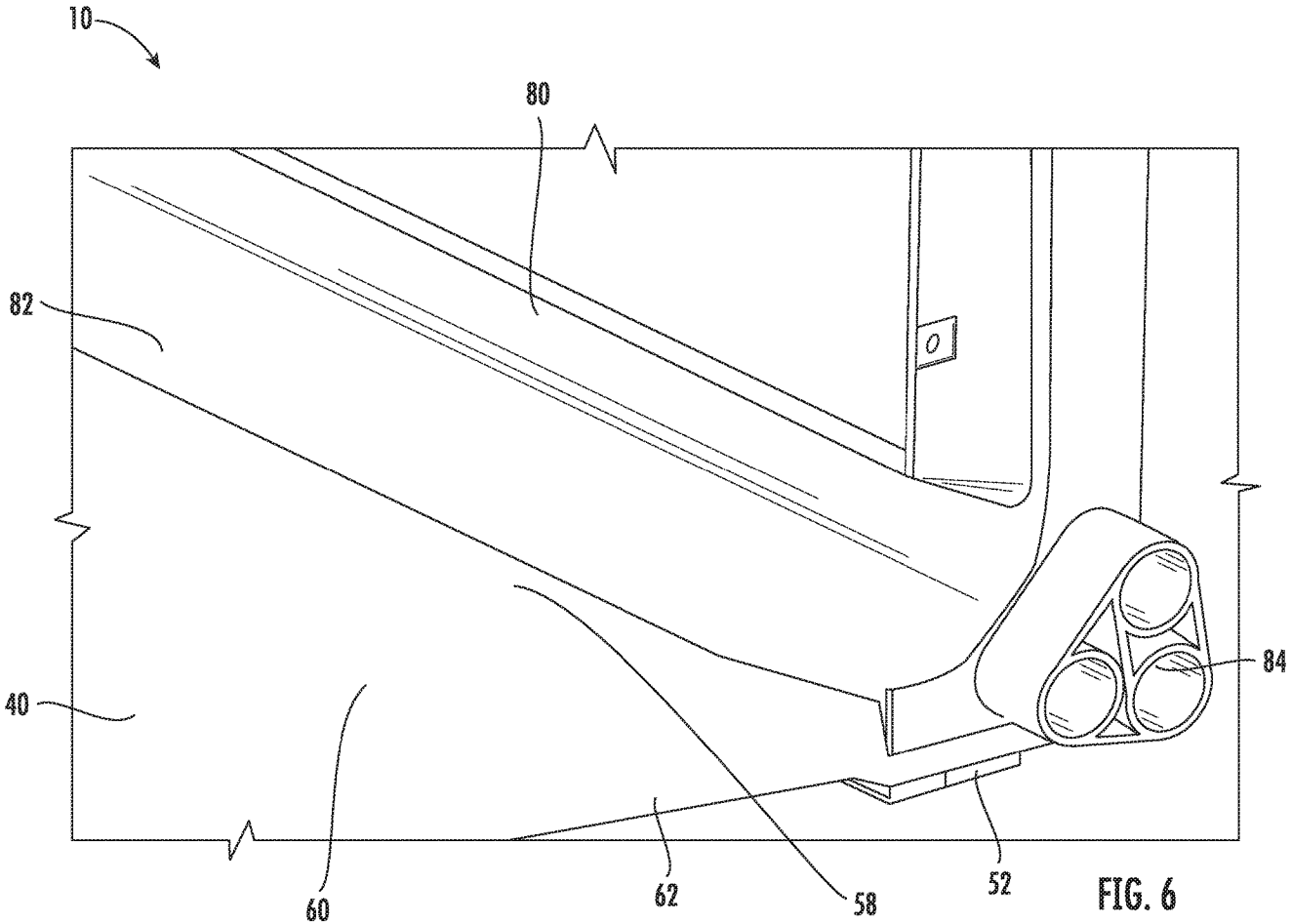
FIG. 6 is a detailed perspective view of a drain pan arranged within a cabinet of a fan coil unit according to an embodiment of the invention.
Figure 7:
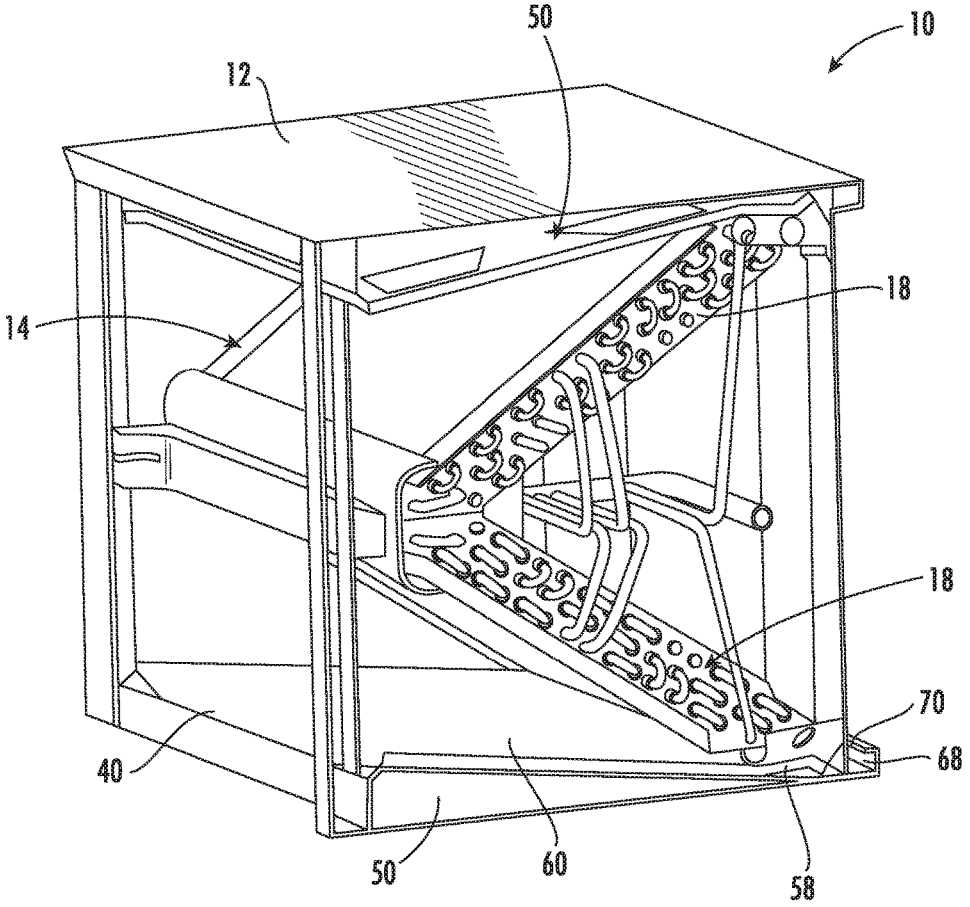
FIG. 7 is a perspective view of a drain pan arranged adjacent a heat exchanger coil within a cabinet of a fan coil unit according to an embodiment of the invention.

Referring now to FIGS. 5-7, the fan coil unit 10 includes at least one drain pan 50 arranged adjacent the heat exchanger assembly 14. As the air flowing through the heat exchanger assembly 14 is cooled, at least a portion of the water within the air condenses and collects on the fins of the heat exchanger 14. Gravity and the continued air flow through the heat exchanger assembly 14 may cause a portion of the collected condensation to fall from the heat exchanger 14 onto the adjacent drain pan 50. Another portion of condensate may run down the fin edges of the heat exchanger 14 to the plastic drain pan 80.

The drain pan 50 includes a body 52 generally formed from a thin, structurally rigid material, such as sheet metal for example. The body 52 includes a generally horizontal section 58 adjacent a first end 54. A generally angled section 60 extends from the horizontal section 58 to a second, opposite end 56 such that the second end 56 is spaced apart from the plane of the first end 54 by a vertical distance. The slope of the angled section 60 causes condensate on the drain pan 50 to flow towards the first end 54 thereof. In one embodiment, the sides 62, 64 of the angled section 60 may be similarly arranged at an upward angle to the center of the angled section 60 to direct water towards the middle of the drain pan 50. Elastomeric foam insulation 40 having a closed cell structure is positioned over the surface (not shown) of the angled section 60 and the adjacent horizontal section 58. In one embodiment, the elastomeric foam insulation 40 is bonded to the surface of the body 52, such as with glue or another adhesive for example.

Arranged at the first end 54 of the body 52 is a first connector 66 configured to couple the first end 54 of the body 52 to a portion of the cabinet 12. In one embodiment, the first connector 66 includes a channel 68 configured to align with a panel 20 of the cabinet 12 such that the drain pan 50 may not move in a direction substantially perpendicular to the plane of the panel 20. Between the channel 68 and the first end 54 of the body is a substantially transition portion 70. Though the transition portion 70 is generally triangular in the non-limiting illustrated embodiment, a transition portion having another shape is within the scope of the invention. The transition portion 70 is generally complementary to and is configured to receive a plastic drain pan 80. When the plastic drain pan 80 engages the transition 70 of the first connector 66, a portion 82 of the plastic drain pan 80 extends over the horizontal section 58 of the body 52. The portion 82 of the plastic drain pan 80 overlapped with the horizontal section 58 and the elastomeric foam insulation 40 positioned on the angled section 60 of the body 52 may be substantially aligned. In one embodiment, the plastic drain pan 80 may be angled such that the condensate flows to at least one drain 84 arranged at a side of the plastic drain pan 80. The second end 56 of the body 52 may similarly include a second connector 72 including a channel 74 configured to align with another panel 20 of the cabinet 12 such that the body 52 may not move in a direction substantially perpendicular to the plane of the panel 20. As the fan coil unit 10 operates, condensation that forms on the heat exchanger assembly 14 will fall onto the elastomeric foam insulation 40 lining the angled section 60 of the drain pain 50. The condensate will flow from the elastomeric foam insulation 40 onto the plastic drain pan 50 and out at least one drain 84 arranged at the sides of the cabinet 12. In one embodiment, multiple drain pans 50 may be arranged within a fan coil unit 12, such as adjacent opposing sides of a heat exchanger assembly 14 for example.

By lining the panels 20 of the cabinet 12 of a fan coil unit 10 with an elastomeric foam insulation 40, the amount of cool air that contacts the panels 20 of the cabinet 12 is reduced, thereby resulting in a significant reduction in the amount of condensation formed on the exterior of the unit 10. In addition, the elastomeric foam insulation may be easily cleaned and generally includes anti-bacterial properties. Inclusion of the sloped drain pan 50 lined with elastomeric foam insulation 40 will also reduce the internal static pressure within the cabinet because an additional, plastic horizontal drain pan is not necessary, thus resulting in lower power consumption by the fan assembly 16. Multiple drain pans 50 arranged within a fan coil unit 10 allow the unit to be installed without any additional positioning of the pans 50 based on the orientation of the unit 10.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

The invention claimed is:

1. A drain pan assembly comprising:

a rigid body having a horizontal section adjacent a first end and an angled section extending from the horizontal section to a second, opposite end such that a plane of the second end is spaced apart from a plane of the first end by a vertical distance, wherein at least one side of the angled section is oriented to direct condensate toward a center of the angled section;

an elastomeric foam insulation forming a lining over a surface of the rigid body;

a first connector extending from the first end of the rigid body, the first connector including:

a channel; and a transition portion arranged between the first end of the rigid body and the channel, the transition portion extending at an angle to the horizontal section of the rigid body; and a drain pan including at least one drain, the drain pan having a contour complementary to the transition portion such that the drain pan is positioned adjacent the transition portion in overlapping arrangement with the horizontal section of the rigid body, wherein the drain pan is aligned with the elastomeric foam insulation positioned on the angled section of the rigid body to receive a flow therefrom.

2. The drain pan assembly according to claim 1, wherein the at least one side of the angled section includes a first side and a second side arranged at an upward angle to a center of the angled section of the body.

3. The drain pan assembly according to claim 1, wherein the channel is configured to align with a panel of a cabinet of a fan coil unit.

4. The drain pan assembly according to claim 1, further comprising a second connector extending from the second end of the rigid body, the second connector including a channel configured to align with a panel of a cabinet of a fan coil unit.

5. The drain pan assembly according to claim 1, wherein the transition portion is triangular in shape.

6. The drain pan assembly according to claim 1, wherein the portion of the drain pan abuts the elastomeric foam insulation positioned over the angled section of the rigid body to form a flow path from the angled section to the drain pan.

* * * * *